United States Patent [19]

Woulds

[11] 3,960,552

[45] June 1, 1976

[54] COBALT ALLOY

[76] Inventor: Michael J. Woulds, 1200 E. Ocean Blvd., Long Beach, Calif. 90802

[22] Filed: Oct. 21, 1974

[21] Appl. No.: 516,649

[52] U.S. Cl. ..... 75/171; 148/32; 148/32.5

[51] Int. Cl.[2] ..... C22C 19/07

[58] Field of Search ..... 75/171, 170; 148/32, 148/32.5

[56] References Cited

UNITED STATES PATENTS 3,432,294 3/1969 Wheaton ..... 75/171

*Primary Examiner*—R. Dean

*Attorney, Agent, or Firm*—Fulwider, Patton, Rieber, Lee & Utecht

[57] ABSTRACT

There is disclosed a cobalt-base alloy that is ideally suited for high temperature service such as for the fabrication of cast vane parts of gas turbine engines. The alloy possesses excellent high temperature strength and corrosion resistance and exhibits extended service life in such applications. The alloy is cobalt-base and contains, as matrix alloying elements, chromium, tungsten and nickel. The alloy also contains carbon and primary carbide formers of tantalum and titanium. The chromium, cobalt and tungsten are also effective as secondary carbide formers to impart extended life to the metal under high temperature and stress conditions. In contrast to prior alloys, the alloy is free of any alloying amounts of zirconium and exhibits excellent casting characteristics. The alloy also preferably contains a significant amount of aluminum to impart the desired long service life for high temperature applications.

8 Claims, 7 Drawing Figures

COBALT ALLOY

BACKGROUND OF THE INVENTION

1. Field of the Invention

This invention relates to cast, cobalt-base alloys and, in particular, relates to cobalt-base alloys that are particularly useful for high temperature service under corrosive conditions.

2. Brief Statement of the Prior Art

Cobalt-base alloys have been developed with various alloying elements to achieve prolonged life in high temperature and corrosive gaseous environments. This development has been primarily directed to providing suitable metallurgy for gas turbine engines and, in particular, for turbine stator vanes which are contacted by hot combustion gasses. The general objective for such applications is to furnish a metal having an extended service life under prolonged stress, stress cycling and corrosive attack as experienced in gas turbine service. For such applications, the metal should have sufficient initial ductility to withstand the hardening or embrittlement that frequently accompanies its use under these service conditions. Additionally, the metal should have a high tensile strength and creep resistance through a wide temperature range of expected applications, e.g., from about 1000°F up to or approaching combustion gas temperature such as up to about 2000°F. Resistance to corrosive agents such as sulfides and chlorides encountered in gases is also required.

Cobalt-base alloys and, in particular, carbide-strengthened, cobalt-base alloys have been developed for this service and have exhibited excellent service life. Generally, these alloys contain a matrix formed principally of cobalt with chromium, tungsten and nickel as matrix alloying elements and with carbides of tantalum, zirconium and titanium. Typical of such alloys is that described in U.S. Pat. No. 3,432,294.

Zirconium is not entirely suitable for use in the alloy because it reacts both with crucible used for melting, as well as the ceramic mold materials encountered during casting of the machine elements, frequently resulting in rejection of the molded parts. This is reported at A.S.M. Metals Engineering Quarterly, Vol. 9, No. 2, pp 24–45, May, 1969, "Casting Cobalt-Base Superalloys", by M. J. Woulds. The mold reactivity is particularly acute in large section thicknesses of castings, where the metal in contact with the shell mold remains hot for prolonged periods, allowing the metal-mold reaction to proliferate. Accordingly, it is desirable to provide a zirconium-free, cobalt-base alloy.

BRIEF STATEMENT OF THE INVENTION

This invention includes the elimination of zirconium as an alloying ingredient in a cobalt-base, carbide-hardened alloy for casting. The removal of zirconium from the aforedescribed cobalt-base, carbide-strengthened alloy, results in an unavoidable degradation of the high temperature strength and ductility of the alloy which may in some applications be objectionable.

I have also found that an excellent cobalt-base, carbide-strengthened, zirconium-free alloy can be provided by the incorporation of a minor amount of aluminum as an alloying element in the metal. It has been found that the incorporation of a minor amount of aluminum, e.g., from 0.25 to 3.00 percent, imparts excellent high temperature service life to the cobalt-base alloy. The alloy composition on a weight percent basis, therefore, consists essentially of from 24 to 27 percent chromium, 9 to 11 percent nickel, 6 to 8 percent tungsten, 2.5 to 4.5 percent tantalum, 0.2 to 0.6 percent titanium, 0.5 to 0.7 percent carbon, 0.25 to 3.00 percent aluminum with the balance being cobalt. There are also present minor amounts of elements normally found associated with the raw materials used for producing the alloy. These are silicon, manganese, phosphorus, iron, sulfur and boron, the total sum of said minor elements not exceeding about 2 percent. The aluminum is present in the aforesaid amount, sufficient to impart the improved strength characteristics to the alloy. This alloy is free of any alloying quantities of zirconium and, therefore, exhibits excellent casting properties.

The mechanism by which the aluminum functions in the alloy is not entirely understood since aluminum is not a carbide forming element and, therefore, can not be expected to function as a substitute or equivalent for the zirconium. The aluminum has been found in the matrix and has not been detected in either of the primary carbides. Regardless of the mechanism by which the aluminum functions in the base alloy, I have found that excellent high temperature strength and ductility can be achieved by its use in the aforedescribed amounts.

BRIEF DESCRIPTION OF DRAWINGS

The drawings accompanying this application illustrate the invention as follows.

DESCRIPTION OF PREFERRED EMBODIMENTS

Figure 1:
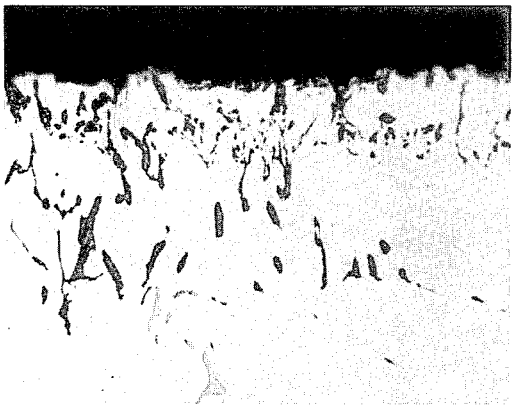
FIG. 1 is a photomicrograph of a surface section of a zirconium containing, cobalt-base alloy.

The alloy composition is a carbide-strengthened, cobalt-base alloy. The major alloying constituents which are present in the matrix of the alloy comprise: chromium, in an amount from 20 to 27 percent; nickel, in an amount from 9 to 11 percent; and tungsten, in an amount from 6 to 8 percent. The chromium imparts hot strength and corrosion resistance to the alloy and exhibits its maximum effect at optimum concentrations from about 24.5 to about 25.5 percent, which comprise a preferred concentration range for this element. The nickel functions as a stabilizing agent for the matrix and enhances the ductility and strength of the alloy. The tungsten is a matrix strengthener and functions, together with the cobalt and chromium as a source of secondary carbides to impart high temperature, long time stress resistance to the metal.

The alloy is carbide-strengthened and contains a sufficient quantity of carbon to provide the desired carbide concentration, it also imparts fluidity to the molten alloy, thereby enhancing castability. Typically, the amount of carbon that can be employed for this purpose is preferably from 0.5 to 0.7 percent. Tantalum and titanium form primary carbides, which have the empirical formula MC, M being a cipher to represent the tantalum and titanium present in the carbide. Typically the alloy contains from 2.5 to 4.5 percent tantalum and from 0.2 to 0.6 percent titanium, with the sum of the percentages of tantalum and titanium equal to or greater than 2.75 and the weight ratio of tantalum to titanium being equal to or greater than 4. These carbides are present as discrete particles within the matrix and are distinctly visible in photomicrographs of the alloy. The carbon should be present in an amount in excess of the stoichiometric amount necessary to form the primary tantalum and titanium carbides and form sufficient secondary carbides, described hereinafter, to impart the desired high temperature strengths to the alloy. Generally this comprises not less than 1 atomic percentage of excess carbon.

The elements of chromium, cobalt and tungsten react with this excess of carbon to produce both primary and secondary carbides which prolong the high temperature service life of the castings under stressed conditions. The primary carbides, which have the empirical formula $M_7'C_3$, M' being a cipher to represent mixed cobalt, chromium and tungsten with minor traces of other elements, are found in the as-cast condition of the aluminum-containing alloy and are clearly visible in photomicrographs of the alloy. It is believed that the addition of aluminum to the alloy alters the atomic structure of the alloy matrix so that the most stable carbide phase in the as-cast alloy is the $M_7'C_3$. The secondary $M_{23}''C_6$ carbides, M'' being a cipher to represent mixed cobalt, chromium and tungsten with minor traces of other elements, have different elemental proportions that the M' mixture. These secondary carbides, by a diffusion mechanism, function by precipitating at localized regions of high stress concentrations during the high temperature service of the metal, thereby providing stress relief to the metal structure and preventing premature creep failure. The titanium, chromium, and aluminum also serve to provide a protective self-healing oxide coating on the alloy products.

When the aforedescribed cobalt base alloy is provided free of any zirconium as an alloying element, it has been found that its high temperature strength and service life are degraded by the absence of zirconium, a prior art, alloying element. The zirconium, however, is not entirely inert and reacts with the ceramic crucible and mold materials during casting of the metal parts. The preferred alloy composition of this invention is free of any alloying amounts of zirconium and contains from 0.25 to about 3.00 percent aluminum. This also has been observed to exhibit excellent casting properties while, nevertheless, also exhibiting excellent high temperature service life and strength. Preferably, aluminum is present in an amount from 0.30 to about 1.5 weight percent and, most preferably from 0.35 to about 0.75 weight percent.

FIG. 1 illustrates the extent of the reactivity of a zirconium-containing alloy with the mold used in its casting. The alloy contained 0.5 weight percent zirconium and the illustrated section was from a 1 inch diameter center pole formed during casting. The metal surface was etched in electrolytic 5 weight percent phosphoric acid and the photomicrograph is at 250 × magnification. This procedure was employed for all photomicrographs presented herein.

The photomicrograph shows extensive internal carbide oxidation, resulting in black areas, increasing in population density at the metal surface. The degree of this oxidation of the carbides increases with zirconium content with increasing exposure of the alloy at elevated temperatures to the mold materials, i.e., the degree of attack increases as the size and thickness of the cast alloy increases, and/or as the zirconium content increases.

Figure 2:
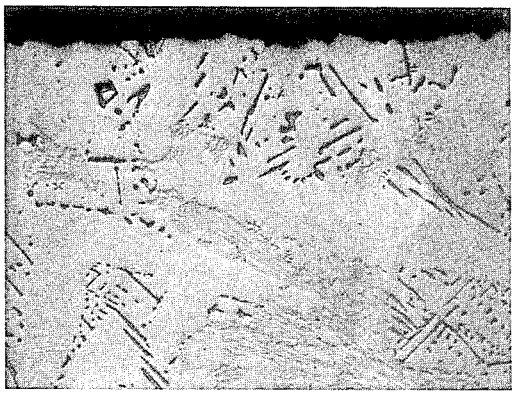
FIG. 2 is a photomicrograph of the surface of an alloy free of zirconium and aluminum.

FIG. 2 is a photomicrograph of a surface section of a cobalt-base, zirconium-free alloy of the invention. The alloy employed contained 0.45 weight percent aluminum. This section was also taken from a 1 inch diameter center pole and treated as the section illustrated in FIG. 1. In contrast to the alloy shown in FIG. 1, the alloy of the invention is free of any carbide oxidation and has an interface free of black appearing oxides. The alloy can also be seen to have a very pronounced script morphology of primary carbides which will be described in greater detail in reference to FIGS. 3–6.

The alloy can also contain the various impurity elements in incidental or trace amounts such as silicon, manganese, phosphorus, iron, sulfur and boron in an amount up to about 2 percent. Of these, iron is the major impurity, frequently present in an amount up to about 1.5 percent, manganese and silicon can each be present in an amount up to about 0.2 percent and boron can be present in an amount up to about 0.05 percent.

The master alloy should be initially produced under conditions insuring the substantially complete removal of dissolved and combined forms of oxygen. This can be accomplished in the conventional manner by induction melting the alloying elements and combining these elements while under a vacuum, e.g., at subatmospheric pressures of about 10 microns or lower and maintaining the alloying ingredients under this vacuum pressure for a sufficient time to completely remove oxygen therefrom. The alloy may also be produced by melting previously cast material, i.e., scrap castings, gates, risers, etc. either using 100% of this material or by blending this scrap stock and virgin metal to produce the desired chemistry. Since the carbon is reactive with oxygen at the alloy melt temperature, the carbon can be used as an oxygen scavenger and can be added initially in quantities slightly in excess of the aforementioned concentration, the amount in excess of this concentration being sufficient to react with the oxygen present in the alloy ingredients, thereby reducing the carbon as well as the oxygen content to the acceptable level. This use of carbon as a deoxidant, where the reaction product is a gas, and is thus easily removed by the vacuum system, ensures minimal loss of the reactive elements, such as aluminum and titanium when they are added to the melt. The proper carbon content can be achieved by sampling the melt, analyzing the sample for carbon and then adjusting the melt ingredients, e.g., by adding the amount of carbon necessary to reach the desired carbon content. The master alloy thus produced can then be remelted for casting and such remelt operation should also be conducted at a vacuum level comparable to that used in the master melting to prevent oxidation. Other methods could also be used for master melting and remelting, e.g., blanketing under an inert gas or in air by controlled melt additions.

The invention will be illustrated by the following examples that will present typical compositions and results obtainable thereby.

EXAMPLE

A master alloy batch is prepared and, from this batch, four separate remelts are prepared. Aluminum is added in incremental additions to three of the remelts at concentrations of 0.1, 0.2, and 0.5 weight percent. The remelts are cast into a ceramic mold having a number of standard test bar configurations. The test bars are examined, X-rayed for internal soundness and subjected to mechanical testing.

The compositions of the master alloy and remelts are set forth in the following table:

| | Master Alloy | Remelt No. 1 | No. 2 | No. 3 | No. 4 |
|---|---|---|---|---|---|
| Carbon | 0.59 | 0.58 | 0.62 | 0.61 | 0.54 |
| Manganese | 0.03 | 0.03 | 0.03 | 0.03 | 0.03 |
| Silicon | 0.06 | 0.05 | 0.06 | 0.07 | 0.06 |
| Phosphorus | 0.001 | <0.001 | <0.001 | <0.001 | <0.002 |
| Sulfur | 0.005 | 0.003 | 0.003 | 0.002 | 0.003 |
| Chromium | 23.00 | 23.34 | 23.07 | 23.72 | 23.69 |
| Nickel | 9.80 | 9.95 | 10.02 | 10.08 | 9.88 |
| Iron | 0.25 | 0.16 | 0.15 | 0.17 | 0.23 |
| Tungsten | 7.10 | 7.09 | 7.00 | 7.18 | 7.10 |
| Titanium | 0.29 | 0.23 | 0.21 | 0.22 | 0.23 |
| Zirconium | <.01 | <0.02 | <0.02 | <0.03 | <0.02 |
| Boron | <.001 | <0.001 | <0.001 | <0.002 | <0.001 |
| Tantalum | 4.00 | 3.72 | 3.81 | 3.51 | 3.48 |
| Aluminum | 0.03 | 0.02 | 0.10 | 0.27 | 0.45 |
| Cobalt | Balance | Balance | Balance | Balance | Balance |

The remelted alloys were cast into clusters of standard ASTM test bars, 025 inch in diameter and subjected to standardized strength testing. Sections were taken from test bars subjected to testing at 1500° F., surface etched with electrolytic 5 weight percent phosphoric acid, and photomicrographs were prepared of the alloy surfaces at 250 × magnification. Representative photomicrographs of remelts 1, 2, 3 and 4 are presented herein as FIGS. 3–6, respectively.

Figure 3:
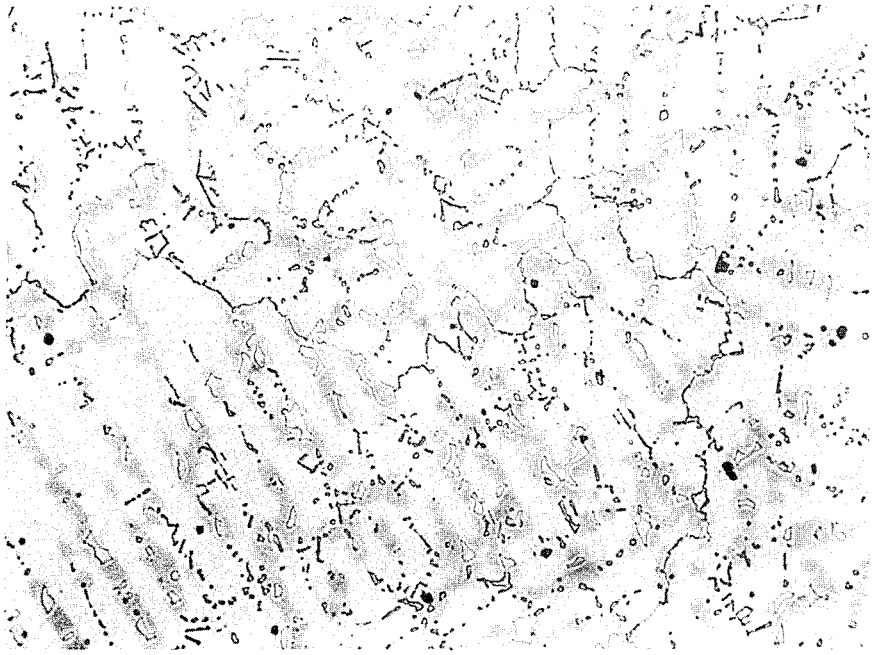
FIGS. 3–6 are photomicrographs of alloys free of zirconium and containing progressively greater aluminum contents.

FIG. 3, a photomicrograph of alloy remelt 1 which is free of aluminum and zirconium, shows the primary MC carbides as elongated dark lines, the primary and eutectic $M_{23}'C_6$ carbides as halo-encircled areas, and the secondary $M_{23}''C_6$ carbides as shaded grey areas surrounding the primary carbides.

Figure 4:
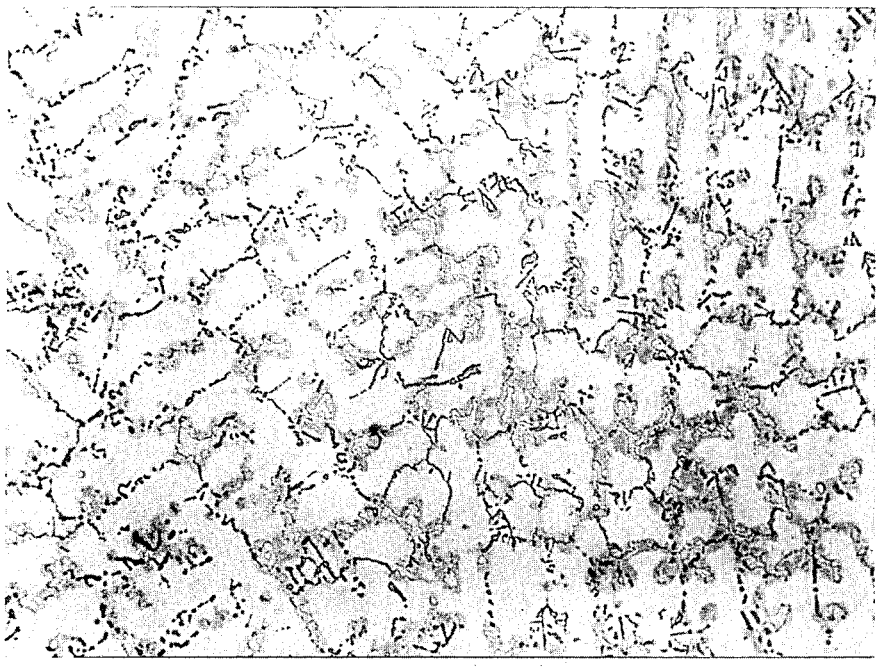

In FIG. 4, the MC carbide script morphology is more pronounced with the primary and eutectic $M_7'C_3$ carbides appearing as light etching areas surrounded by $M_{23}''C_6$ carbides as grey etching areas.

Figure 5:
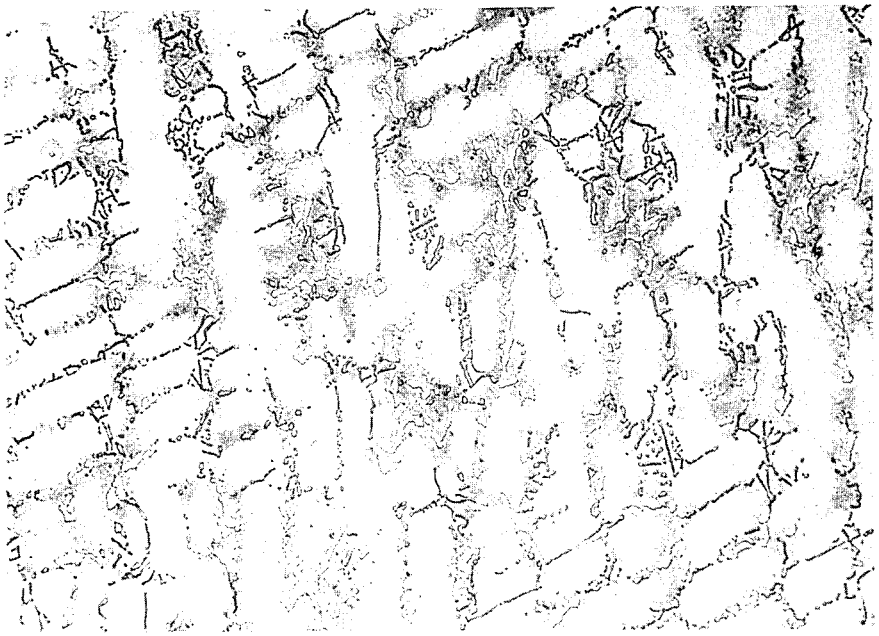

FIG. 5 is similar to FIG. 4, however, the script morphology of the MC carbides is more pronounced.

Figure 6:
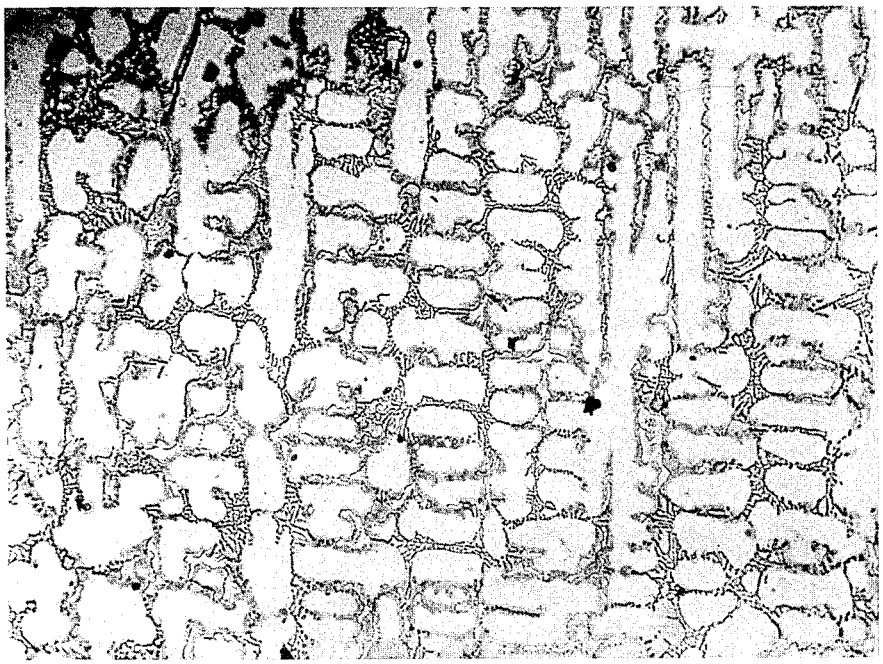

FIG. 6 shows the continuing increase in script morphology of the MC carbides with increasing aluminum content which has resulted in a cellular appearance. It also illustrates alignment of the elongated carbide phases in the direction of heat transfer within the metal alloy.

The results of the mechanical testing of the four remelt specimens are presented in the following tables together with a comparative inspection of a prior art alloy prepared in accordance with U.S. Pat. No. 3,432,294:

TABLE 2

| Room Temperature Tensile (values in Ksi.) | Remelt No.1 | Remelt No.2 | Remelt No.3 | Remelt No.4 | Patent 3,432,294 |
|---|---|---|---|---|---|
| UTS | 121.0 | 113.0 | 118.0 | 111.0 | 113 |
| 0.2% YS | 75.6 | 72.9 | 71.5 | 68.9 | 85 |
| Elongation % | 7.0 | 7.0 | 6.0 | 5.0 | 3.5 |
| Red. in Area % | 4.0 | 4.8 | 4.1 | 4.8 | 5.0 |

TABLE 3

| II. Stress Rupture at 2000°F/9000 psi: | Remelt No. 1 | Remelt No. 2 | Remelt No. 3 | Remelt No. 4 | Patent 3,432,294 |
|---|---|---|---|---|---|
| Life (Hours) | 14.2 | 18.7 | 31.2, 35.2 | 31.5 | 35.0 |
| Elongation % | 8.9 | 10.1 | 1.5, 4.5 | 5.1 | 9.0 |
| Red. In Area % | 16.9 | 16.0 | 3.1 | 6.2 | 12.0 |

TABLE 4

| III. Stress Rupture at 1800°F/17,500 psi: | Remelt No. 1 | Remelt No. 2 | Remelt No. 3 | Remelt No. 4 | Patent 3,432,294 |
|---|---|---|---|---|---|
| Life (Hours) | 14.2 | 12.0 | 64.9 | 39.1 | 30.0 |
| Elongation % | 13.0 | 14.0 | 16.0 | 4.0 | 13.0 |

TABLE 5

| IV. Creep Rupture at 1500°F/35,000 psi | Remelt No. 1 | Remelt No. 2 | Remelt No. 3 | Remelt No. 4 | Patent 3,432,294 |
|---|---|---|---|---|---|
| Life (Hours) | 112.8 | 165.3 | 90.6 | *200.0 + | 170.0 |
| Creep (%) | 11.9 | 10.75 | 11.38 | *6.5 | |
| Elongation % | 12.1 | 11.3 | 12.1 | | 12.0 |
| Red. In Area % | 15.3 | 17.7 | 23.9 | | 15.0 |

*Testing discontinued at 200 Hours

The results of the testing reveal that the absence of zirconium in the master alloy as exemplified in remelt No. 1 resulted in a product having generally degraded service life at elevated temperatures, compared to that prepared in accordance with the prior art patent. The addition of the incremental quantities of aluminum to the remelts, however, resulted in significant improvements in service life of the remelt alloys at elevated temperatures. It can be seen that, generally speaking, the addition of aluminum substantially restores the elevated temperature properties of the alloy that are lost due to the removal of zirconium. This restoration in most cases yields properties comparable to those possessed by the prior art alloy, and in many instances, exceeds those properties. One particularly dramatic improvement is in the room temperature elongation values, which are double those of the prior art alloy. This is particularly advantageous in the cyclic operation of castings made from this alloy, where a degree of toughness, as reflected by room temperature ductility, is required. The incremental addition of aluminum to the remelts can be seen from the tabulated data to exhibit a progressive increase in the service life of the alloy at elevated temperatures.

Figure 7:
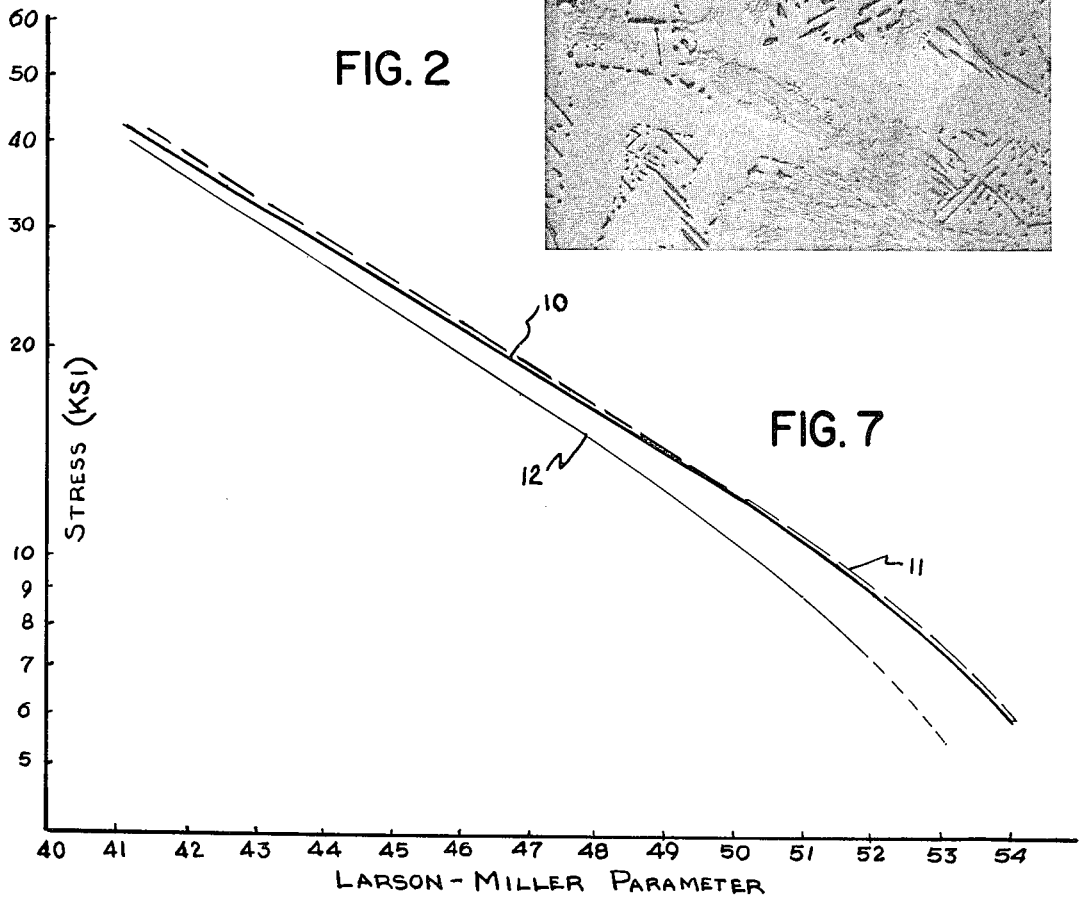
FIG. 7 depicts Larson-Miller curves for the alloys of the invention and for a prior art, zirconium-containing alloy.

The effect of aluminum on the high temperature service life and strength of the cobalt-base, zirconium-free alloy is illustrated by the Larson-Miller curves of FIG. 7. These curves are logarithmic plots of stress, in thousand pounds per square inch, against the Larson-Miller parameter for the particular alloy. This parameter reflects the stress capabilities of the alloys at various temperatures. As shown in FIG. 7, the Larson-Miller curve for a prior art, zirconium-containing, cobalt-base alloy is shown by line 10. The Larson-Miller curve for remelt 1, free of zirconium and aluminum, is shown by line 12. This line illustrates that the properties of the alloy are degraded by removal of zirconium. The addition of aluminum in remelts 2–4, however, progressively increased the high temperature strengths of the alloys. This is shown by the Larson-Miller curve, line 11, for remelt 4 which is above line 10, reflecting better properties of remelt 4 than those possessed by the prior art alloy.

All concentrations disclosed and claimed herein are expressed in weight percentages of the alloy product.

The invention has been described with reference to the illustrated and presently preferred embodiment thereof. It is not intended that the invention be unduly limited by this exemplified illustrated and presently preferred embodiment. Instead, it is intended that the invention be defined by the ingredients and their amounts, and equivalents thereof, set forth in the following claims.

What is claimed is:

1. A cobalt-base alloy free of zirconium as an alloy element and consisting essentially of from 20 to 27 percent chromium, 9 to 11 percent nickel, 6 to 8 percent tungsten, 2.5 to 4.5 percent tantalum, 0.2 to 0.6 percent titanium, 0.5 to 0.7 percent carbon, 0.25 to 3.0 percent aluminum and the balance being cobalt, said aluminum being present in the aforesaid amount, sufficient to impart improved strength chracteristics to said alloy.

2. The alloy of claim 1 having a matrix formed principally of said cobalt, chromium, nickel and tungsten.

3. The alloy of claim 2 wherein said carbon forms primary carbides of a MC structure wherein M is principally tantalum and titanium and is present in excess of the amount in said carbides.

4. The alloy of claim 3 wherein said carbon also forms primary carbides having a $M_7'C_3$ structure wherein M′ represents principally chromium, cobalt and tungsten.

5. The alloy of claim 2 wherein said carbon is also present in a carbide phase of a $M_{23}''C_6$ structure wherein M″ represents principally chromium, cobalt and tungsten.

6. The alloy of claim 1 wherein said chromium is present at a concentration from about 24.5 to 25.5 percent.

7. The alloy of claim 1 wherein said aluminum is present at a concentration from about 0.3 to 1.5 weight percent.

8. The alloy of claim 1 wherein said aluminum is present at a concentration from 0.35 to 0.75 weight percent.

* * * * *